US008267749B2

(12) United States Patent
Smith et al.

(10) Patent No.: US 8,267,749 B2
(45) Date of Patent: Sep. 18, 2012

(54) ABRASIVE SHARPENER HAVING SQUARE ABRASIVE RODS

(75) Inventors: Richard S. Smith, Hot Springs, AR (US); Louis Chalfant, Hot Springs, AR (US)

(73) Assignee: Smith's Consumer Products, Inc, Hot Springs, AR (US)

( * ) Notice: Subject to any disclaimer, the term of this patent is extended or adjusted under 35 U.S.C. 154(b) by 538 days.

(21) Appl. No.: 12/381,761

(22) Filed: Mar. 16, 2009

(65) Prior Publication Data

US 2009/0325473 A1 Dec. 31, 2009

Related U.S. Application Data

(60) Provisional application No. 61/069,495, filed on Mar. 14, 2008.

(51) Int. Cl.
*B24B 3/54* (2006.01)

(52) U.S. Cl. ..... 451/349; 451/555

(58) Field of Classification Search ..... 451/65, 451/359, 555, 349
See application file for complete search history.

(56) References Cited

U.S. PATENT DOCUMENTS

| | | | | | |
|---|---|---|---|---|---|
| 1,041,631 | A * | 10/1912 | Johnson | 451/486 |
| 1,719,345 | A * | 7/1929 | Teitel | 76/86 |
| 2,413,169 | A * | 12/1946 | Case | 451/555 |
| 4,530,188 | A * | 7/1985 | Graves | 451/555 |
| 5,477,753 | A * | 12/1995 | Branscum et al. | 76/82 |
| 5,582,535 | A * | 12/1996 | Friel | 451/45 |
| 6,142,038 | A * | 11/2000 | Kenesky et al. | 76/86 |
| 6,168,509 | B1 * | 1/2001 | Presgrove | 451/552 |
| 6,905,403 | B2 * | 6/2005 | Stallegger et al. | 451/555 |
| 7,066,796 | B2 * | 6/2006 | Pfaus | 451/344 |
| 7,229,344 | B1 * | 6/2007 | Wu | 451/349 |
| 7,235,004 | B2 * | 6/2007 | Friel et al. | 451/198 |
| 7,517,275 | B2 * | 4/2009 | Friel et al. | 451/198 |

* cited by examiner

*Primary Examiner* — Maurina Rachuba
(74) *Attorney, Agent, or Firm* — Edward D Gilhooly

(57) ABSTRACT

An abrasive sharpener having a body and an integral handle. The body possesses a pair of upper slots for receiving an edge to be sharpened. One of slot has a pair of crossed diamond abrasive rods having a square cross section generally along its length. The other slot includes a pair of abutting ceramic blades having triangular configuration. Two offset slot portions having a ceramic rod is also provided on the body.

6 Claims, 1 Drawing Sheet

ABRASIVE SHARPENER HAVING SQUARE ABRASIVE RODS

This application claims priority to provisional application, Ser. No. 61/069,495 filed Mar. 14, 2008.

BACKGROUND OF THE INVENTION

Field of the Invention

This invention relates to abrasive sharpeners for knives and scissors, and more particularly, to an abrasive sharpener having the capability of extending the lifetime of service of the abrasive elements.

SUMMARY OF THE PRIOR ART

In the past sharpeners using one or more abrasive rods are well known in the prior art. Often, the rods employ ceramic, diamond or other abrasive surfaces. It is common for the rods to be mounted in crossing relationship within a slot for sharpening scissors, knives, and the like. Known abrasive rods are generally round in cross section and do not attain an optimum lifetime of service due to their inherent configuration. Such a need to replace abrasive rods on more frequent basis, particularly expensive rods, such as those formed of diamonds, is uneconomical and inconvenient. Accordingly, it is desirable in the prior art to provide an improved abrasive rod design capable of an extended lifetime of service.

SUMMARY OF THE INVENTION

It is therefore an objective of the invention to provide an improved abrasive sharpener. The invention herein includes multiple sharpening slots having ceramic, diamond or other abrasive rods, stones or blades. The cross sectional of the rods of the invention are square and can be reversed and rotated to adjustably provide eight different surfaces per rod to greatly extend the effective life of the sharpening rod, such as an relatively expensive diamond rod.

DESCRIPTION OF THE PREFERRED EMBODIMENT

Figure 1:
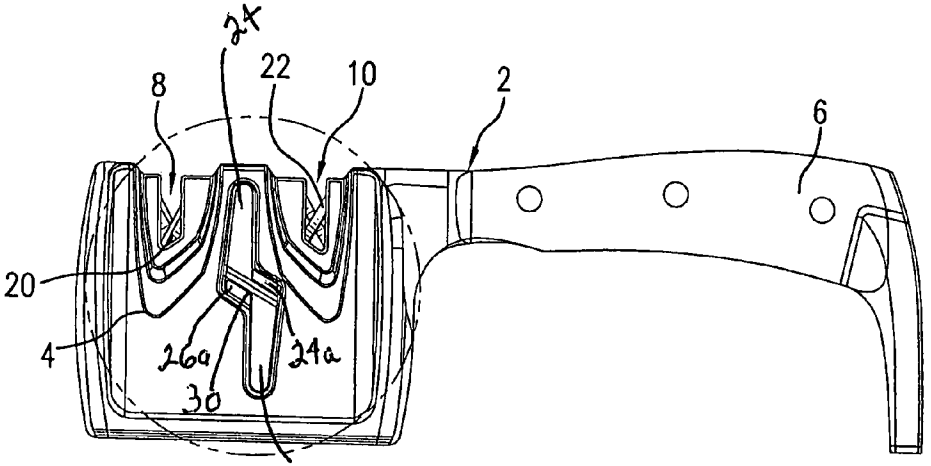
FIG. 1 is a front elevational view of the abrasive sharpener of the invention.
Figure 2:
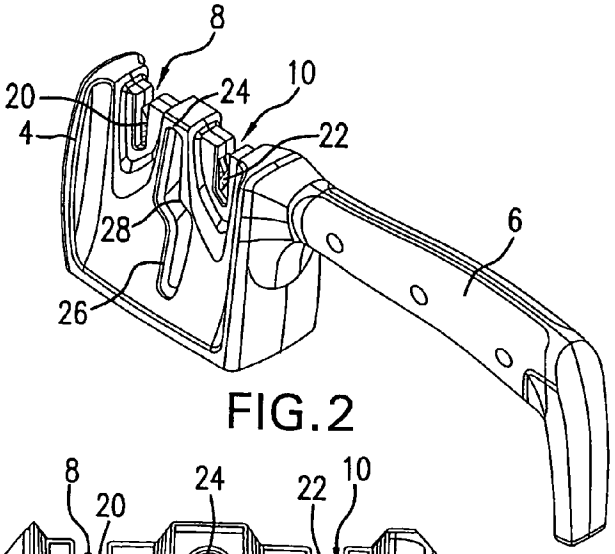
FIG. 2 is a front perspective view of the abrasive sharpener of FIG. 1.
Figure 3:
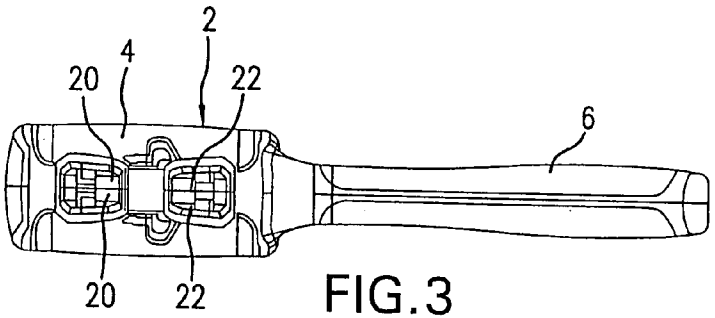
FIG. 3 is a top plan view of the sharpener of FIG. 1.

Referring now to FIGS. 1-4, there is illustrated the abrasive sharpener of the invention, generally designated by reference numeral 2. The sharpener 2 has a body 4 formed with an elongated handle 6. As seen in FIG. 3, the body 4 is relatively narrower in width than its length (FIG. 1). The body 4 includes a first slot 8 and a second slot 10. The first slot 8 is formed on the top of body 4 and has a pair of crossed ceramic abrasive blades 20 having a triangular shape. The blades 20 are removably mounted within the slot in a well known manner.

A pair of crossed diamond rods 22 having a square cross section is removably mounted in slot 10 on the top of body 4.

Figure 4:
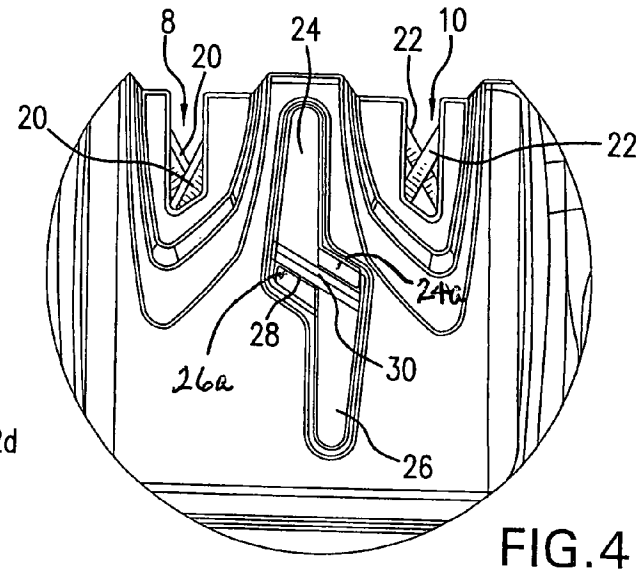
FIG. 4 is an enlarged partial front elevational view of the sharpener of Fig.
Figure 5:
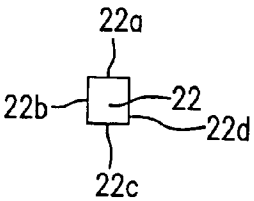
FIG. 5 is a cross-sectional view of the square rod of FIG. 1.

A knife and the like may be pulled or pushed through either slot 8 or slot 10 to be sharpened by the abutting ceramic abrasive blades 20 or the crossed diamond abrasive rods 22. Generally, the diamond rods 22 provide a more coarse sharpening result than the carbide blades 20. Two off-set vertical sloped slots 24 and 26 that are interconnected by a mid-slot 28 are provided between slots 8 and 10 and extend to a lower portion of body 4. A ceramic rod 30 of a circular cross-section is suitably mounted in an angular manner in mid-slot 28 for a sharpening task by inserting the either right hand or left hand scissors or the like to be sharpened in slot 24 and slot 26. Sloped flat surfaces 24*a* and 26*a* are formed by chamfers on body 4 at the ends of slots 24, 26 adjacent mid-slot 28 and rod 30 as best seen in FIGS. 1 and 4 and on which scissors blades bear during sharpening. The chamfers permit the scissors to be inserted farther into the respective slots 24 and 26 for sharpening a greater portion of the blades of scissors and more types of scissors.

The square cross sectional configuration of diamond rods 22 having four flat abrasive surfaces or faces 22*a*,22*b*,22*c*, and 22*d* extending generally along the length of the rod allow them to be rotated through suitable mounting in the body 4. Such turning of the rods 22 as needed after use allows the rods to be rotated to create four distinct flat sharpening surfaces. The rods 22 are also removably mounted off center so that they are capable of being rotated and reoriented from top to bottom which creates a total of eight different sharpening surfaces per rod. This capability of square rod 22 offers an extended sharpening life to the diamond surface. It is within the scope of the invention to use the crossed square rods of the invention by themselves in a sharpener or with other abrasive elements other than those that are described herein. The square rods 22 can employ other abrasive materials where an extension of the lifetime of the abrasive is desirable.

What is claimed is:

1. An abrasive sharpener for sharpening the edges of implements comprising a body having an interior slot for receiving edges of the implements to be sharpened, said slot forming an exterior opening through which edges to be sharpened can be inserted, said body having opposed side walls forming a periphery and said slot exterior opening being within said periphery of said side walls, an abrasive rod being mounted in the slot, and said body having sloped surfaces immediately adjacent said exterior opening to form generally flat chamfers on which the implements bear during insertion into said slot to sharpen a greater portion of the edges.

2. The abrasive sharpener according to claim 1 wherein said body further includes a upper sharpening slot having at least one abrasive rod, said at least one rod has a square cross sectional configuration generally along is length.

3. The abrasive sharpener according to claim 2 wherein said at least one rod includes a pair of abrasive rods having four flat surfaces extending generally along their length in said upper sharpening slot.

4. The abrasive sharpener according to claim 3 wherein said pair of abrasive rods are crossed.

5. The abrasive sharpener according to claim 3 wherein said at least one abrasive rod includes a diamond abrasive being applied to each of said flat surfaces.

6. An abrasive sharpener for sharpening the edges of implements comprising a body having an interior slot for receiving edges of the implements to be sharpened, said slot forming an exterior opening through which edges to be sharpened can be inserted, an abrasive rod being mounted in the slot, said body having sloped surfaces immediately adjacent said exterior opening to form chamfers on which the implements bear during insertion into said slot to sharpen a greater portion of the edges, and said interior slot of said body has a pair of offset slots having said abrasive rod.

* * * * *